United States Patent [19]

Ishida

[11] 3,946,853

[45] Mar. 30, 1976

[54] ESCALATOR BELT CLEANER

[76] Inventor: Koji Ishida, 3 of 5, Ryoke 1, Urawa, Saitama, Japan

[22] Filed: May 15, 1974

[21] Appl. No.: 470,023

[30] Foreign Application Priority Data

Sept. 27, 1973 Japan ..... 48-112727[U]
Jan. 23, 1974 Japan ..... 49-10757[U]

[52] U.S. Cl. ..... 198/16 R; 198/229
[51] Int. Cl.[2] ..... B61B 13/14
[58] Field of Search ..... 198/230, 229, 16 R, 16 MS; 401/9–11; 15/210 R, 210 B, 256.5

[56] References Cited

UNITED STATES PATENTS

| | | | |
|---|---|---|---|
| 2,550,918 | 5/1951 | Felix et al. | 198/16 R |
| 2,846,045 | 8/1958 | Fowler | 198/16 R |
| 2,980,942 | 4/1961 | Dabney | 401/10 |

FOREIGN PATENTS OR APPLICATIONS

| | | | |
|---|---|---|---|
| 765,866 | 1/1957 | United Kingdom | 198/230 |

*Primary Examiner*—Robert J. Spar
*Assistant Examiner*—James M. Slattery
*Attorney, Agent, or Firm*—Fidelman, Wolffe & Waldron

[57] ABSTRACT

A C-shaped resilient housing for encompassing at least three sides of an escalator belt and biasing a solution bearing pad into continuous abutment with the escalator belt. Ribs interior to the housing and flanges exterior to the rear of the housing may be included to hold the pad in place.

9 Claims, 8 Drawing Figures

ESCALATOR BELT CLEANER

BACKGROUND OF THE INVENTION

1. Field of the Invention

This invention relates generally to belt cleaning apparatus and more specifically to an escalator belt cleaner for the cleaning and disinfection of the belt during normal operating conditions.

2. Description of the Prior Art

In department stores, etc., of some countries, until several years ago, an escalator girl has been stationed for each escalator and the cleaning and disinfection of the escalator belt were effected at ordinary times by the escalator girl using a house-cloth to which disinfecting solution was applied. Such stationing of elevator girls, however, has been abolished due to the difficulty of obtaining a personnel for such purpose and to an increased personnel expenses. However, there has not yet been developed a simple device capable of effecting during use of the belt the cleaning and disinfection of the belt in a manner sufficient to act for the role which escalator girls have played. For this reason, escalator belts, including those used in subway stations which have rapidly increased in recent years, are either left to be dirty or, at best, taken care of by an occasional cleaning. Such a situation is deleterious from the standpoint of public health and further, it gives an unclean feeling to those who utilize the escalator.

SUMMARY OF THE INVENTION

The present invention is a device for enclosing at least the top and two sides of an escalator belt and to clean and disinfect the belt during use. A generally C-shaped resilient housing which encompasses more than the top and two sides of the escalator belt is provided for biasing a solution bearing pad into continuous abutment with the top and two sides of the escalator belt. The solution bearing pad is a generally U-shaped member having a first layer of cleansing agent impregnated material for abutting the belt and a second layer of resilient material between the first layer and the housing for biasing the first layer into abutment with the belt. The solution bearing pad is removably secured within said housing. Flanges are provided at the rear edge of the housing for engaging the pad and preventing it from lateral movement relative to the housing. Ribs may also be provided internal to the housing for engaging the edge of the cleansing pad holding it in place. A horizontal plate or struts or other structures internal to the generally C-shaped housing may be provided to add additional biasing for the portion of the U-shaped pad which comes into contact with the top of the belt. The impregnated layer and the resilient layer of the pad may be mounted on a third layer which provides a degree of rigidity to the cleaning pad. The inside width of the housing is to be less than the sum of the width of the top of the escalator belt and twice the thickness of the cleansing pad, so as to produce the biasing condition against the sides of the belt. The general C-shaped housing ends extend around the bottom of the belt and lies adjacent thereto so as to prevent the cleaning device from falling off the belt during use.

OBJECTS OF THE INVENTION

To an object of the present invention is to provide a device which performs the function of cleaning and disinfecting belts during their operation.

Another object of the invention is to provide an inexpensive device for cleaning and disinfecting an escalator belt during their operation.

A further object of the invention is provision of a replacable cleansing pad within a housing so as to extend the life of the present invention by using substitute pads.

Another object is to provide an inexpensive, economical and easy to install escalator belt cleansing and disinfectives device.

A further object of this invention is to provide an escalator cleaning device which remains in continuous contact or abutment with the top and two sides of the escalator belt during normal operation of the belt. Other objects, advantages and novel features of the present invention will become apparent from the following detailed description of the invention when considered in conjunction with the accompanying drawings.

PREFERRED DESCRIPTION OF THE EMBODIMENTS

Figure 1:
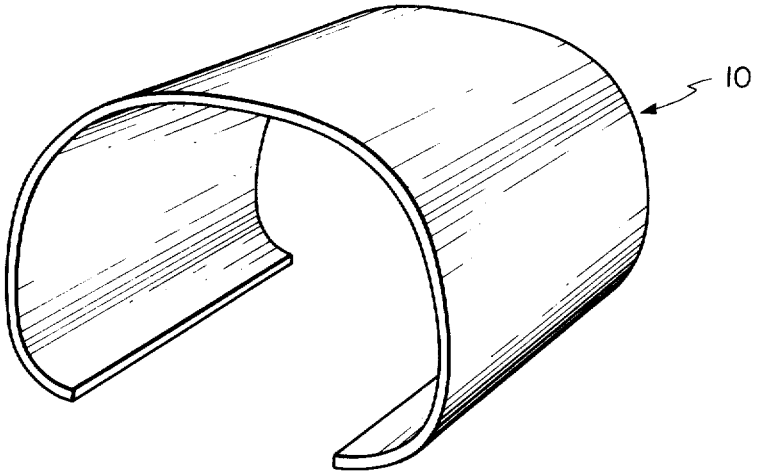
FIG. 1 is a perspective view of the housing.
Figure 2:
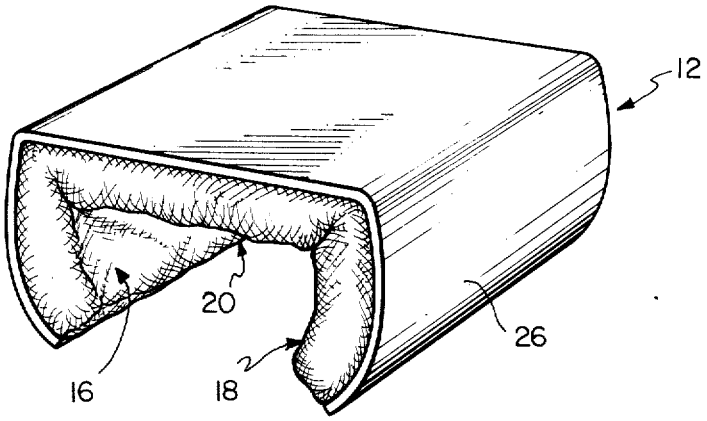
FIG. 2 is a perspective view of the cleansing pad.
Figure 3:
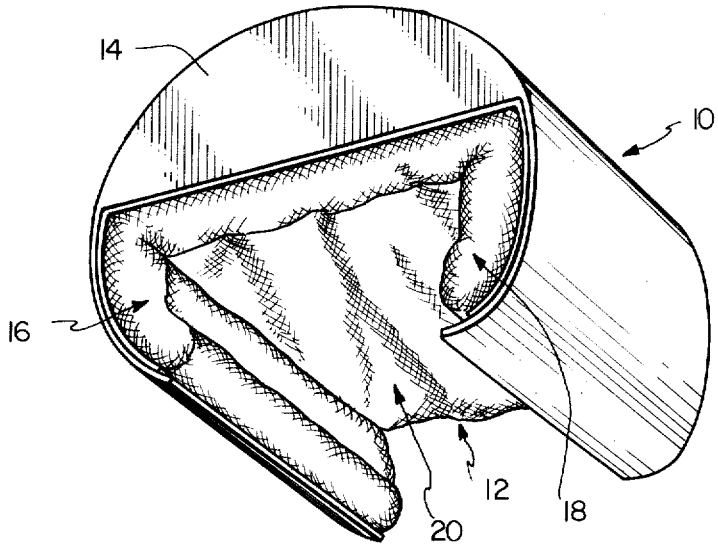
FIG. 3 is a perspective view of the pad and housing in combination.

FIG. 1 illustrates a preferred embodiment of the housing 10 as being generally C-shaped. A solution bearing pad 12, as shown in FIG. 2, is generally U-shaped and is received within the housing 10 as shown in FIG. 3. After the insertion of the cleansing pad 12 into the housing 10 a plate or flange 14 is added to one end of the housing 10.

The pad 12 has side portions 16 and 18 and a top portion 20. Portions 16, 18 and 20 will be in continuous contact or abutment with and thereby cleanse the two sides and the top of an escalator belt 21, as shown in cross-section in FIG. 4. Flange 14 of housing 10 overlaps a portion of the top segment 20 of the pad 12 to prevent it from moving laterally relative to housing 10. At the other end of housing 10 another plate 14 may be provided but it is not necessary for the effective operation of the present invention. Since the belt moves relative to the housing in one direction, the placement of the plate 14 at the back end of the housing will prevent the pad 12 from moving relative to the housing 10.

Figure 4:
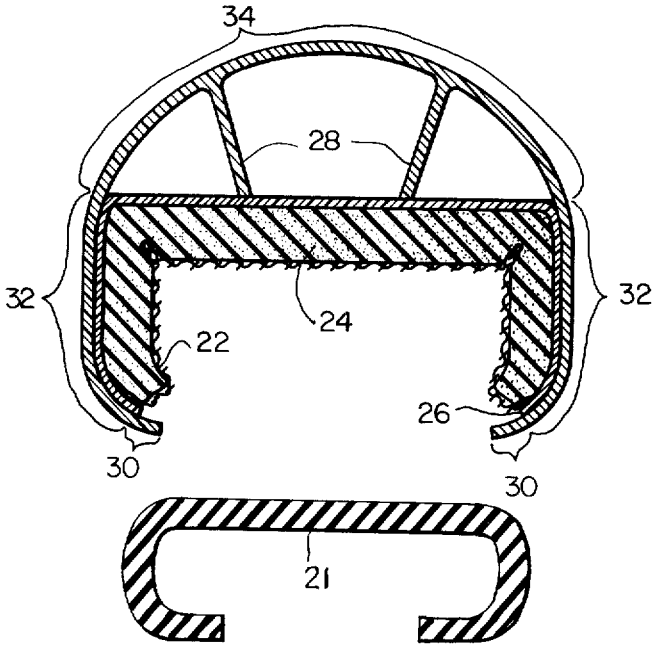
FIG. 4 is a cross-sectional view of one embodiment of the housing and pad inserted therein.

As illustrated in the cross-section of FIG. 4, the solution bearing pad 12 is made up of a cloth or cleansing agent impregnated material 22 over a second layer of resilient or cushioning material 24, both of which are mounted to a third layer of material 26 which provides a degree of rigidity to the cleansing pad 12. The first material layer 22 may be of a conventional cloth which directly abuts the belt face. The thick cushioning member 24 maintains the material layer 22 in a uniform contact or abutment with the belt faces (top and two sides). The material of layer 22 must be strong enough so as to not be destroyed or abraded during its frictional contact with the faces of the belt, yet be porous enough so as to retain a cleansing and disinfectant solution. Suitable natural or synthetic fibers such as woven or non-woven cloths may be used for this purpose. The cushioning or biasing layer 24 may be made from synthetic resins such as foam, polyurethane, and styrols (cotton, sponge, wastepaper, etc.). Though the layers 22 and 24 are shown as one continuous piece, it is well within the scope of the present invention that each segment or leg 16, 18 and 20 of the pad 12 may be separate and distinct elements.

The third layer of material 26 which provides a degree of rigidity to the cleansing pad 12 may be made of synthetic resins or thick papers such as cardboard and corrogated cardboard. The cloth layer 22 is secured to the cushion or biasing layer 24 which in turn is secured to the base member 26. The three layers 22, 24 and 26 may be secured to each other by adhesive for example. The cleansing pad 12 may be made in a flat configuration and folded so that it is substantially U-shaped having legs 16 and 18 and bight 20. Base 26, by action of its own elastic stress maintains the top abutting portion 20 in abutment with the belts top or upper face, and at the same time acts as the base for mounting the total pad 12 to the frame 10. The base 26 having such a function should be made of material having an elastic stress and rigidity above the average pressure which will be experienced by the bight 20 when in abutment with the escalator belt. By forming the general C-shape from pad 12, the elastic stress across base 26 provides pressure upon bight 20 to maintain it in contact with the top face of the belt. To assist plate 26 in providing a biasing effect upon the cleansing layer 22 a pair of struts 28 are provided interior to the C-shaped housing.

The housing 10 is generally C-shaped and is constructed of such dimensions so as to bias legs 16 and 18 of pad 12 into continuous abutment with the sides of the escalator belt for cleaning thereof. The length of bight 20 or of the space between legs 16 and 18 is less than the width of the belt carrying base. Using this criteria, the inside width between the outer walls of housing 10 must be less than the width of the belt plus twice the thickness of legs 16 or 18. These dimensions will allow the flexible housing 10 to provide a biasing effect in combination with the cushion or biasing layer 24 of the pad 12.

The frame 10 terminates in two seizing portions 30, which are adapted to be opposed each other at the lower or under sides of the escalator belt. When the outer frame 10 is positioned on the belt seizing portions 30 are also opposed to the sides of the belt carrying base, and thereby prevent the housing 12 from inadvertently falling off from the belt during use. Seizing portions 30 extend from two opposite acting portions 32 which are adapted to grasp therebetween the pad 12. Elastic top portion 34, from which portions 32 and 30 extend, gives rise to the pressure in the direction of the sides of the belt against the pressure in the adverse direction which tends to expand the opposing acting portions 32. The frame 10 maintains the side abutting portions 16 and 18 in abutment with the sides of the belt with the utilization of pressure of the oppose acting portions 32 in the direction of the side of the belt which is generated by the elastic stress of elastic portion 34.

These elastic stresses are produced since the overall configuration of the housing and the pad are less than the width of the belt. Materials suitable for providing the elastic stress includes synthetic resins, cardboards, sheet metal as examples. To increase the elastic stress in the housing 10 and to insure continuous abutment of the pad 12 with the escalator belt, the distance between the upper tip ends of the seizing portions 30 and the lower face of the bight 20 of the pad 12 is slightly shorter than the height of the belt.

Pad 12 is placed within the housing 10 and end plates 14 secured thereto, as previously described, to prevent lateral movement of the pad 12 with respect to housing 10 when in use. The pad 12 may be made of inexpensive materials so that spare pads may be inserted. Similarly, the materials of pad 12 may be such as to not cause serious sanitary problems in waste disposal. For example, layer 22 may be cotton cloth, cushion or biasing layer 24 may be waste paper and base 26 may be cardboard.

The escalator belt cleaner of the present invention is mounted on an escalator belt in a manner to seize hold and abut the belt by expanding the opposed acting portions 32 against the elastic stress of the elastic portion 34. Similarly the seizing portions 30 are opposed to both side portions of the lower face of the escalator belt so that the device is prevented from falling off. The present device is dimensioned so that the portions 30, 32 and 34 encompass greater than the top and two sides of the belt. The opposed acting portions 32 exert a force in the direction of the sides of the belt by action of the elastic stress of the elastic portion 34 so that the side abutting portions 16 and 18 are maintained in perfect abutment with the belt's sides. Also by the action of the elastic stress of base 26 the upper abutting portion or bight 20 is in complete abutment with the belt's upper face.

In up escalators, the device is fastened to the escalator device at the inlet of the forward direction where the belt is passed into the interior of the escalator device. In down escalators, the device of the present invention is also fastened to the escalator device where the belt enters the interior of the escalator. In both up and down escalators and in general the position where the belt is passed into the interior of the escalator it is at the lower portion which is difficult to be seen and therefore people will seldom become aware of the escalator belt cleaner of the present invention fastened to the escalator belt.

The device of the present invention cleanses, disinfects, polishes, etc., escalator belts continuously during the operation of the escalator by application of a polish, detergent, disinfectant or perfume to the pad 12.

Figure 5:
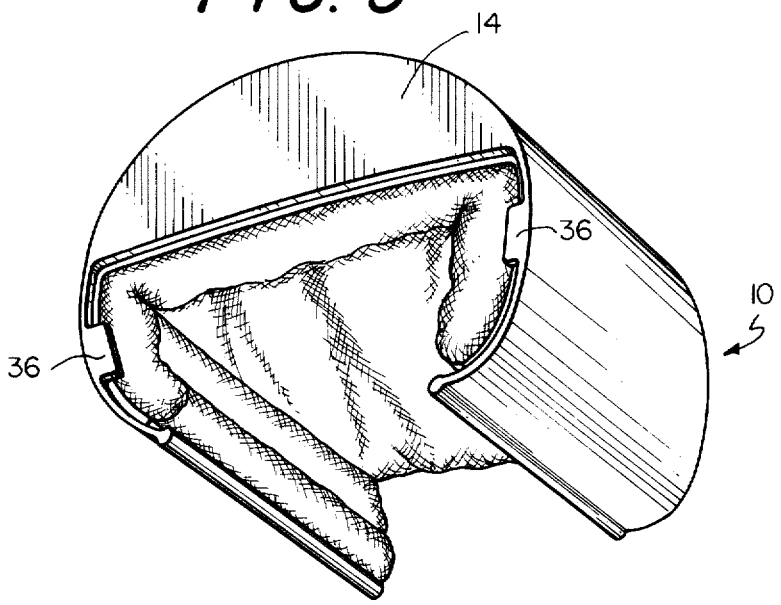
FIG. 5 is a perspective view of a second embodiment of the housing with the pad therein.
Figure 6:
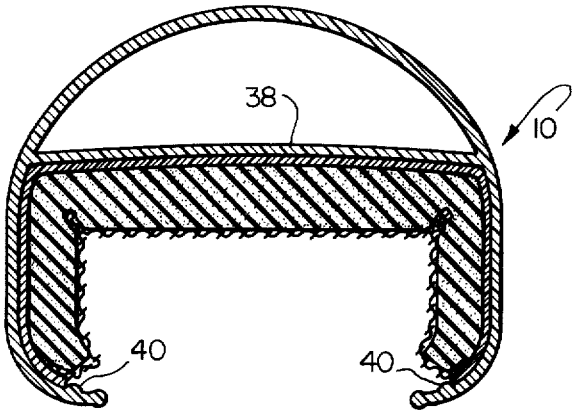
FIG. 6 is a cross-sectional view of the embodiment of FIG. 5.
Figure 7:
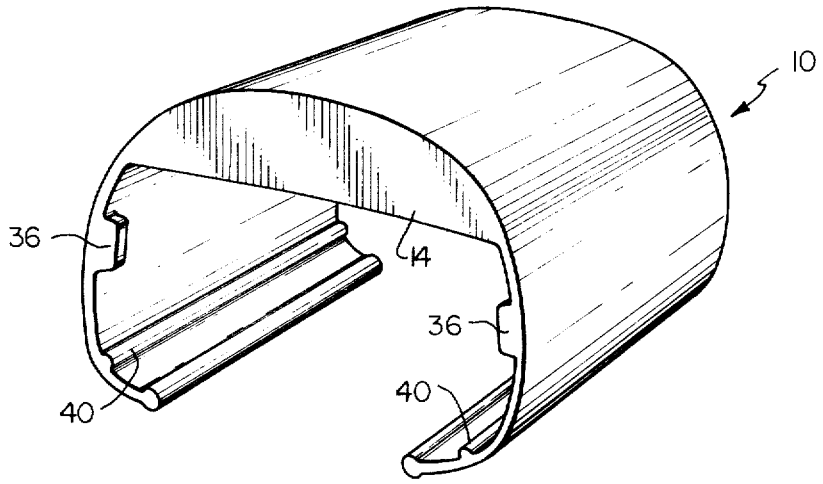
FIG. 7 is a perspective view of the second embodiment of the housing.
Figure 8:
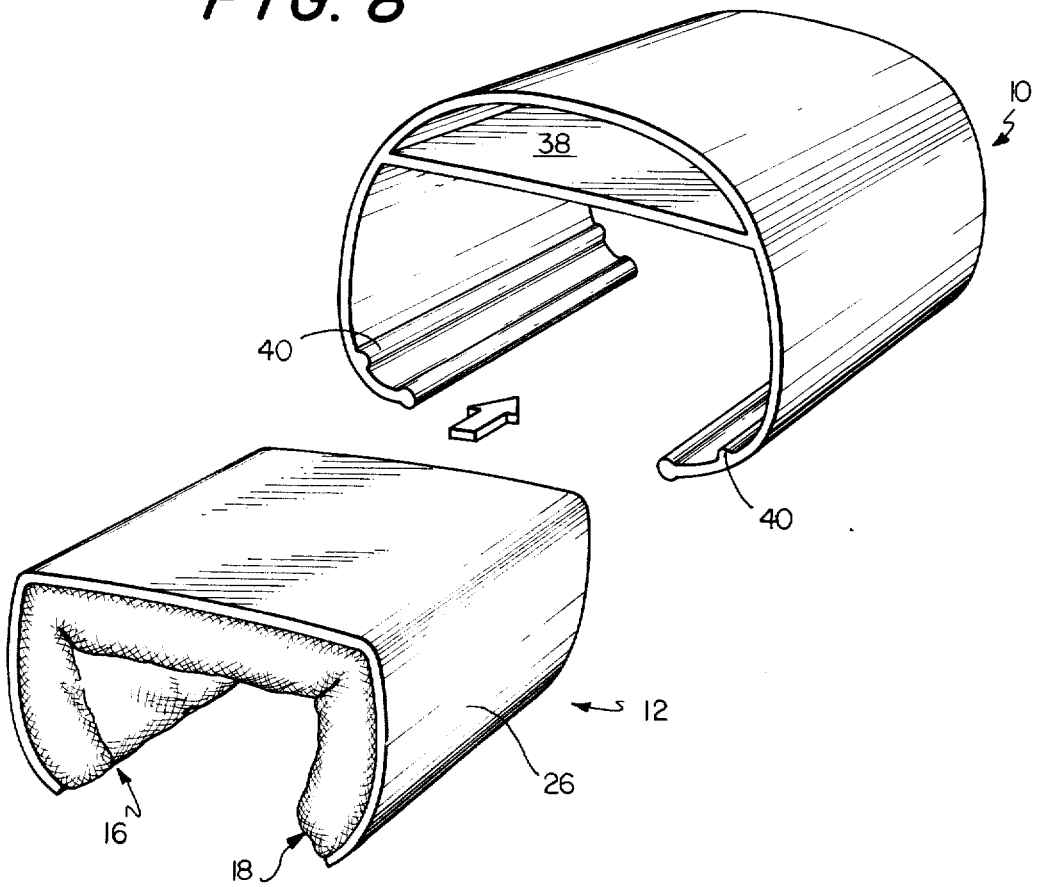
FIG. 8 is a perspective view of the insertion of the pad into the housing of FIG. 7.

Further embodiments of the present invention are shown in FIGS. 5–8. As shown in FIG. 5 for example, supplementary flanges or protrusions 36 are shown extending from the edge of housing 10. These flanges in combination with plate 14 provide a stop for the pad 12 once inserted within housing 10. As mentioned above with respect to plate 14 the flanges 36 need only be placed at the back portion of housing 10. As shown in FIG. 6, in lieu of the struts 28, an additional support number or plate 38 is provided interior to the general C-shaped housing 10 generally parallel to the top of the escalator belt. Plate 38, as did struts 28, hold or bias the bight or top portion 20 of pad 12 into continuous abutment engagement with the top of the escalator belt.

Also provided in the embodiment of FIGS. 5–8 are a pair of ribs 40 interior to and extending substantially the length of the interior of housing 10. The ribs 40 engage the lower edge of legs 16 and 18 and prevent the total pad 12 from moving up and down relative to the housing 10.

As shown in FIG. 10, the escalator belt cleaner of the present invention is formed by inserting the pad or spare pad 12 from the forward end of housing 10 so that the lower edge of legs 16 and 18 ride above ribs 40 and the top portion 20 below plate 38 or struts 28. The pad 12 is inserted until it strikes flanges 36 and the plate 14. Under such conditions, the pad 12 within the frame 10 can be moved only forward towards the front end of the frame 10 and is prevented from moving right or left, up or down and towards the rear when in use.

As set forth hereinbefore, the escalator belt cleaner of the present invention is easy to attach and detach, and once it has been attached to the escalator device, it will continually seize hold of the escalator belt so as to effect cleaning the belt without any additional care until it is replaced. With only a little time required for attaching and detaching operation, the belt cleaning may be continually effected while requiring no assistance. For the users of escalator belt there is provided a cleaned and disinfected belt at all times, which is not only very preferable from sanitary point of view but always satisfies the users' feeling that the belt is clean.

The apparatus of the present invention is so simply constructed that it can readily be manufactured and the raw materials thereof are inexpensive. In addition, the pad in abutment with the belt is made replaceable, which is attractive to purchasers because of its reduced cost. The apparatus of the present invention is further advantageous in that it can dispense with such materials as are likely to cause sanitary harm due to waste disposal. The apparatus of the present invention having the foregoing functions and effects is an extremely superior apparatus.

From the preceding description of the preferred embodiments, it is evident that the objects of the invention are attained and although the invention has been described and illustrated in detail, it is to be clearly understood that the same is by way of illustration and example only and is not to be taken by way of limitation. The spirit and scope of this invention being limited only by the terms of the appended claims.

What is claimed is:

1. In combination, a moving escalator belt having a top, bottom and two sides and a device for cleaning said moving escalator belt, said device comprising:

means for cleansing and abutting said top and two sides of said belt, said cleansing means being generally U-shaped and including a first layer of cleansing agent impregnated material for abutting said belt and a second layer of resilient material for biasing said first layer into abutment with said belt; and means engaging said cleansing means and having a generally C-shaped resilient housing, which encompasses more than said top and two sides of said belt for securing said cleansing means to said belt and biasing said cleansing means into continuous abutment with said top and two sides of said belt.

2. A device as in claim 1 wherein said housing has an inside width less than the sum of the width of said top of said belt and twice the thickness of said cleansing means so as to effect said biasing.

3. A device as in claim 1 wherein said housing includes at least one flange at a rear edge of said housing for engaging said cleansing means and preventing said cleansing means from lateral movement relative to said housing.

4. A device as in claim 3 wherein said cleansing means being generally U-shaped and said flange engage a substantial portion of an edge of the bight of said U.

5. A device as in claim 3 wherein said cleansing means being generally U-shaped and said housing includes at least two flanges each for engaging a portion of an edge of a leg of said U.

6. A device as in claim 1 wherein said housing includes a pair of ribs interior to and spaced from the ends of said C for engaging an edge of said cleansing means.

7. A device as in claim 1 wherein said housing includes a plate interior to said C and parallel to said top of said belt for engaging and maintaining a portion of said cleansing means in abutment with said top of said belt.

8. A device as in claim 1 wherein said housing includes struts interior to said C for engaging and maintaining a portion of said cleansing means in abutment with said top of said belt.

9. A device as in claim 1 wherein said cleansing means further comprises a generally third layer having said first and second layers secured thereto, said third layer being of a material capable of providing a degree of rigidity to said cleansing means.

* * * * *